United States Patent [19]

Peltret

[11] 4,095,924

[45] Jun. 20, 1978

[54] HOUSING FOR FUEL PUMP CONTROL ASSEMBLY

[75] Inventor: Pierre Henri Peltret, London, England

[73] Assignee: Lucas Industries Limited, Birmingham, England

[21] Appl. No.: 719,334

[22] Filed: Aug. 31, 1976

[30] Foreign Application Priority Data

Jul. 2, 1976 United Kingdom ..... 27633/76

[51] Int. Cl.[2] ..... F04B 7/04; F04B 39/10; G05G 11/00

[52] U.S. Cl. ..... 417/499; 123/139 AY; 123/140 MC

[58] Field of Search ..... 417/289, 499, 500; 123/139 BD, 139 AE, 139 E, 140 R, 140 MC, 198 C, 198 DB, 139 AY; 64/10

[56] References Cited

U.S. PATENT DOCUMENTS

| | | | |
|---|---|---|---|
| 2,418,707 | 4/1947 | Groot | 310/90 |
| 2,423,568 | 7/1947 | Slowig | 64/10 |
| 2,462,172 | 2/1949 | Esarey | 310/90 |
| 3,310,939 | 3/1967 | Curran et al. | 123/140 MC |
| 3,313,282 | 4/1967 | Dreisin | 123/140 R |
| 3,421,486 | 1/1969 | Parrish | 123/140 R |
| 3,572,303 | 3/1971 | Becker et al. | 123/140 MP |
| 3,572,304 | 3/1971 | Becker et al. | 123/140 MP |
| 3,640,259 | 2/1972 | Garcea | 123/140 MC |
| 3,918,318 | 11/1975 | Phillips | 123/139 E |

*Primary Examiner*—Carlton R. Croyle
*Assistant Examiner*—Thomas I. Ross

[57] ABSTRACT

A fuel assembly includes a main fuel pump housing from which extends a control rod into a compartment in a housing which also mounts a rotary actuator having a shaft which mounts link means located within the compartment and effecting movement of the aforesaid control rod. The housing includes a dividing wall through which the shaft extends and a fluid seal is provided about the shaft to prevent lubricant which may accumulate in the compartment flowing into a further compartment which contains the actuator.

20 Claims, 5 Drawing Figures

HOUSING FOR FUEL PUMP CONTROL ASSEMBLY

This invention relates to a fuel pump assembly for supplying fuel to an internal combustion engine and comprising a first housing containing a plurality of injection pumps actuable in timed relationship to supply fuel, in use, to the combustion spaces of an associated engine, said injection pumps having a common control member movable to determine the amount of fuel supplied by the injection pumps, the assembly including a second housing which is secured to the first housing and which accommodates a rotary electromagnetic actuator, and tne assembly also including means for operatively connecting the output shaft of the actuator with the control member.

The first housing contains lubricant for the moving parts of the injection pump and it is desirable to prevent this lubricant reaching the actuator. It is also desirable that the means connecting the control member and the output shaft should be efficient as possible to minimise the electrical power required to effect movement of the control member. Moreover, from the servicing point of view it is desirable that the two housings should be easily separated and re-assembled.

According to the invention in an assembly of the kind specified said second housing defines first and second compartments having a dividing wall therebetween, said control member extending into the first compartment, the actuator being located in the second compartment with the output shaft extending through said dividing wall, the axis of movement of said shaft being substantially at right angles to but offset from the axis of movement of the control member, said shaft mounting link means engageable with said control member and said dividing wall mounting a fluid seal member engaging with said shaft to prevent flow of lubricant between said compartments.

One example of a fuel pump assembly in accordance with the invention will now be described with reference to the accompanying drawings in which.

Figure 1:
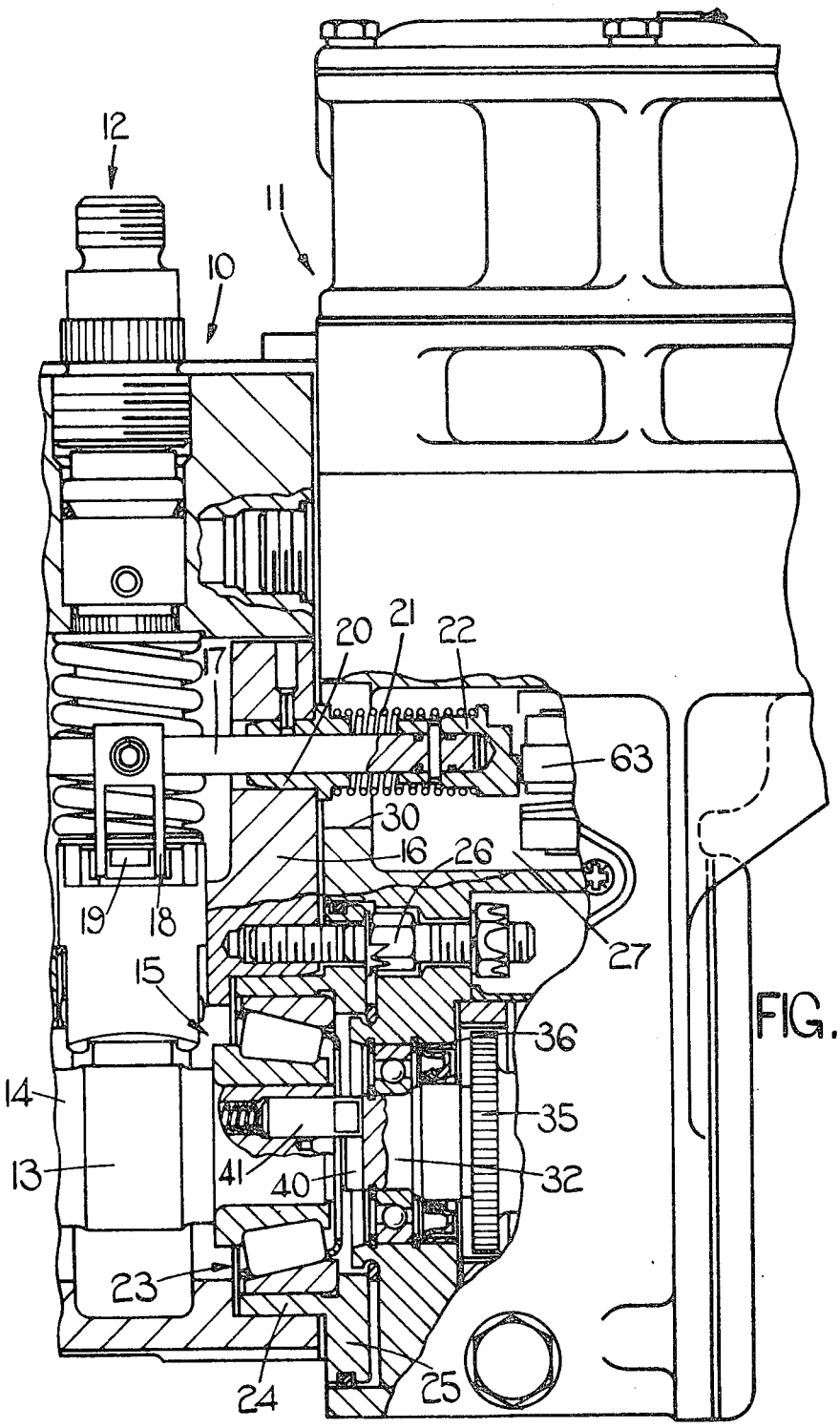
FIG. 1 shows a part sectional side elevation of one portion of the assembly.

Referring to the drawings, the assembly comprises a first housing 10 and a second housing 11. The two housings are secured together by means of bolts.

The housing 10 houses a plurality of individual fuel injection pumps 12 each of which is of a wellknown design. The pumping plungers of the pumps 12 are moved to displace fuel through respective outlets, by means of respective cams 13 mounted on a cam shaft 14. The cam shaft 14 is supported in the housing 10 by means of a bearing assembly 15 located in an end wall 16 of the housing, the cam shaft having a similar bearing at the opposite end of the housing and also intermediate bearings. At the opposite end of the housing to that which is shown, the cam shaft extends through an aperture and in use, is coupled to a drive coupling so that the cam shaft can be driven in timed relationship with the associated engine. Each injection pump is provided with a spring which effects movement of the respective plunger in the direction to draw fuel into the pumping chamber of the pump. The angular settings of the pumping plungers can be adjusted to control the amount of fuel which is supplied through the outlets at each injection stroke. For this purpose a control member 17 is provided and this extends the length of the pump. Forked coupling members 18 are mounted on the control member and these engage with arms 19 respectively which are coupled to the plungers. The control member 17 is movable axially to vary the angular setting of the plungers and in the particular example, movement of the control member 17 towards the right effects a reduction in the amount of fuel supplied by the injection pumps. Conveniently the control member 17 is of square section and is housed within a bearing bush 20 secured within the end wall 16 of the housing 10. The bush 20 also acts as an abutment for one end of a coiled compression spring 21, the other end of which engages a surface formed on a follower 22 which is secured to the control member 17. The action of the spring 21 is to move the control member 17 to the minimum or zero fuel position.

The bearing assembly 15 comprises a tapered roller thrust race 23, the outer member of which is located within a sleeve 24, the sleeve having an integral flange 25 secured by studs 26 in the end wall 16 of the housing 10. The studs are extended and serve to secure the two housings 10, 11 in face-to-face relationship.

The housing 11 is constructed so as to define a first compartment 27, a second compartment 28, and a third compartment 29. As will be seen from FIG. 1, the wall of the housing 11 which is adjacent the wall 16 is provided with an aperture 30 through which the control member 17, the follower 22 and the spring 21 extend. Moreover, the aforesaid end wall of the housing 11 is recessed to accommodate the flange 25 and a fluid seal is formed about the periphery of the flange by a resilient "O" ring housed within a groove formed in the flange.

The compartment 29 houses a speed transducer 31 and this includes a rotary shaft 32 carried on bearings 33, 34, the shaft mounting a toothed wheel 35. An oil seal 36 is provided intermediate the bearing and the toothed wheel so that while the bearing 32 is lubricated by lubricant contained within the housing 10, the seal 36 prevents the lubricant flowing into the compartment 29. The bearing 34 is packed with grease during assembly. The transducer 31 incorporates a pole piece 37 which surrounds the wheel 35 and like the wheel 35, is formed from magnetizable material. The magnetic circuit between the wheel 35 and the pole piece 37 is completed by a stator structure 38 which extends to adjacent the shaft 32. The stator structure mounts a pair of windings shown together at 39 and these are connected by suitable leads to exterior of the housing. The end of the shaft 32 adjacent the housing 10 is provided with a transverse slot 40 and engageable within this slot is a spring-loaded plunger 41 which is mounted within a bore formed in the cam shaft but eccentrically disposed relative to the axis of rotation thereof. Thus, as the cam shaft rotates rotary movement will also be imparted to the shaft 32 and by virtue of the toothed wheel and pole piece 37, an alternating current signal will be produced in the output winding, the frequency of the signal depending upon the speed of rotation of the cam shaft.

Figure 2:
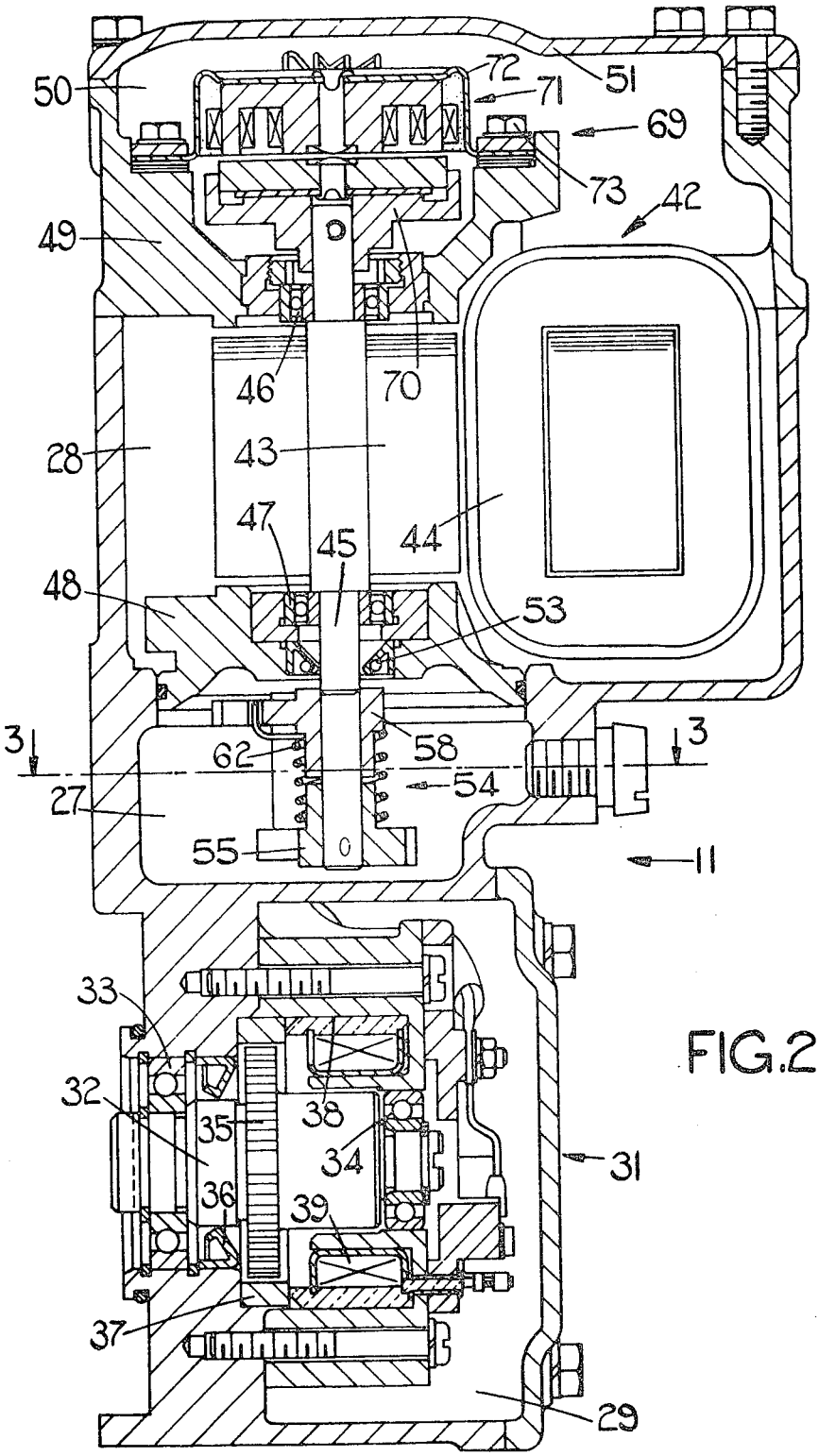
FIG. 2 shows a sectional side elevation of part of the assembly seen in FIG. 1.
Figure 3:
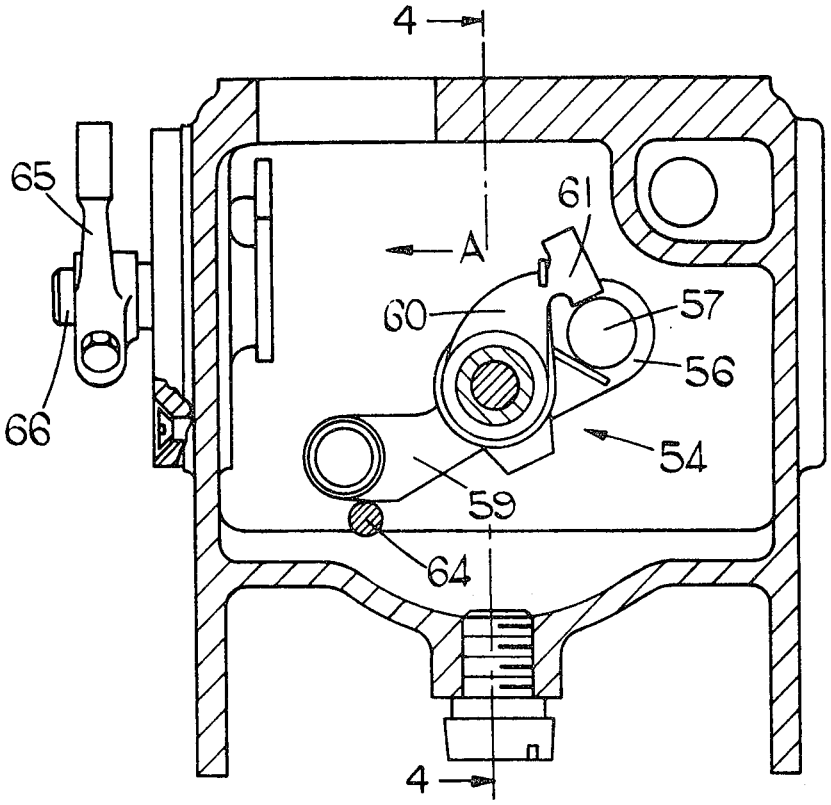
FIG. 3 is a sectional plan view of a position of the assembly of FIG. 2.
Figure 4:
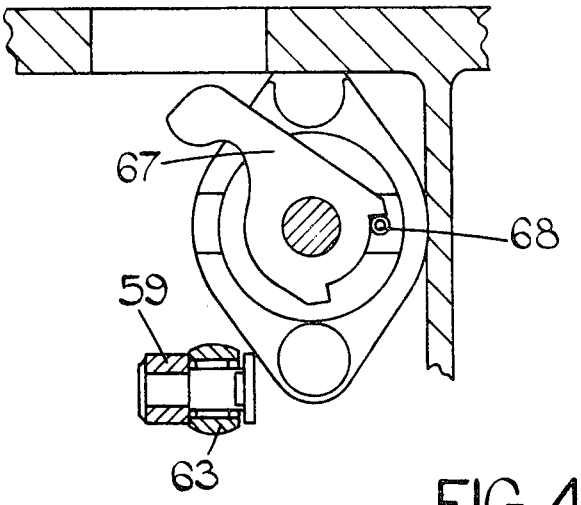
FIG. 4 is a view in the direction of the arrow A of FIG. 3.
Figure 5:
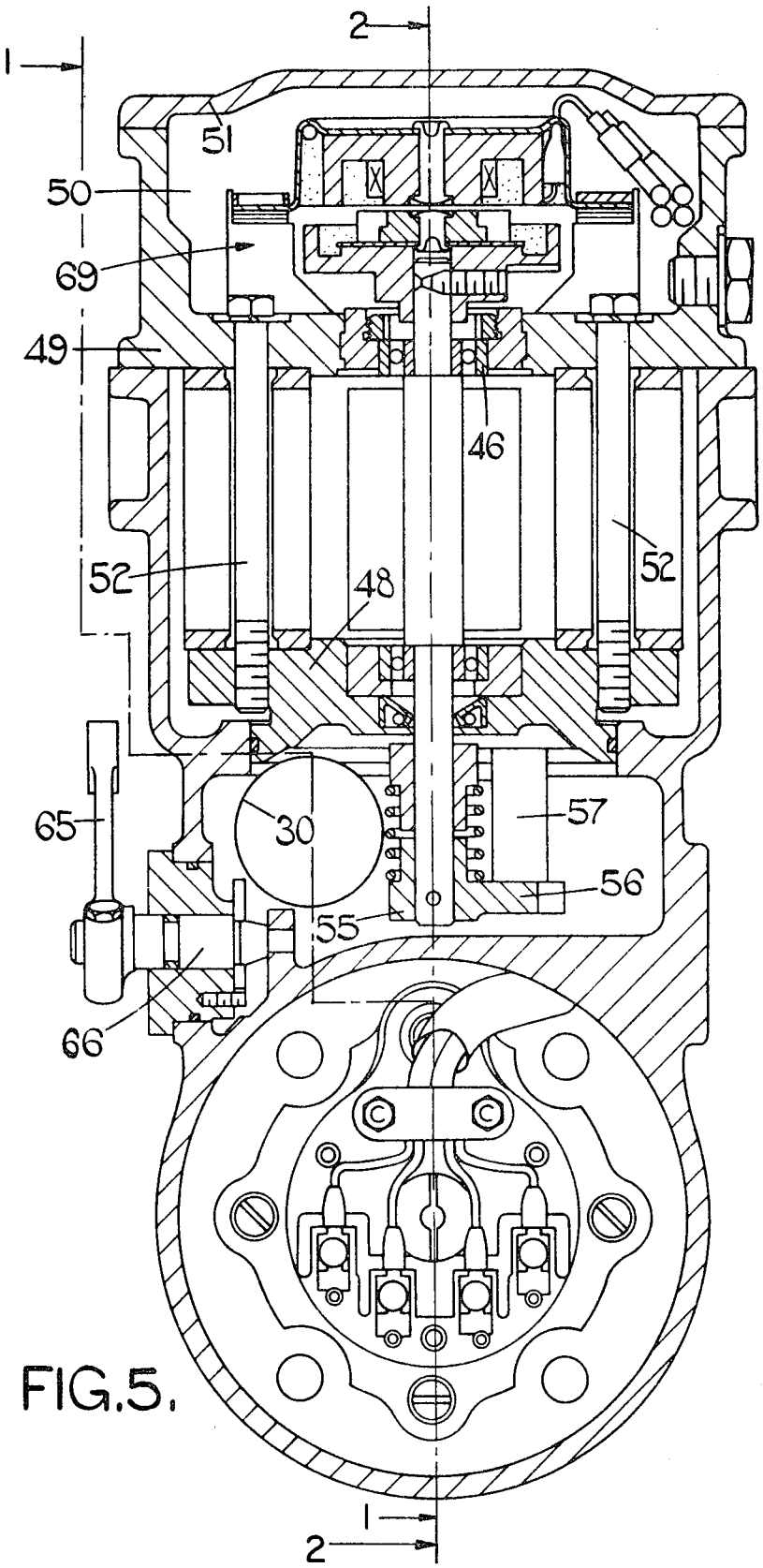
FIG. 5 is a sectional end elevation of right angles to FIG. 2.

Turning now to FIG. 2, the compartment 28 houses an electromagnetic actuator 42 and this comprises a rotor 43 and a stator 44. The rotor is mounted upon a shaft 45 and at its opposite ends, is carried by bearings 46, 47. The axis of rotation of the shaft 45 is substantially at right angles to the axis of movement of the control member 17 and is laterally displaced relative thereto. The lower bearing 47 is mounted within an end plate 48 which forms the dividing wall between the compartments 27 and 28. The end plate has a flange portion which mounts an annular seal so as to establish a fluid-tight seal between the compartments 27 and 28. The bearing 46 is mounted within a housing part 49 which, together with a cover 51, defines a further compartment 50. The end plate 48 and the housing part 49 are secured together by means of through bolts 52 which extend through apertures formed in the stator 44 of the actuator. With the construction described it is therefore possible to assemble the actuator on the housing part 49 and then to assemble the housing part to the remaining portion of the housing.

The end plate 48 also carries a fluid seal 53 which engages with the shaft 45 to prevent any lubricant which may be contained within the compartment 27, flowing into the compartment 28. The shaft 45 extends into the compartment and mounts an arm assembly 54 through which the rotary motion of the shaft 45 is transmitted to effect axial movement of the control member 17. The arm assembly 54 comprises a bush 55 which is secured to the shaft 45 and the bush is provided with an integral arm 56 which carries an upstanding pin 57. Located adjacent the seal 53 is a bush 58 which can move angularly relative to the shaft. The bush 58 carries a pair of arms 59, 60 and the arm 60 is provided with an abutment 61 for engagement with the pin 57 and the abutment and pin are held in engagement with each other by means of a coiled torsion spring 62 one end of which engages the pin 57 and the other end of which engages the arm 60 adjacent the abutment 61.

The arm 59 carries a pin about which is mounted a roller 63, the roller being positioned when the two housings are secured together, to engage the follower 22 carried by the control member 17. The extent of movement of the roller 63 together with the follower 22 under the action of the spring 21 is limited by a stop pin 64. The strength of the spring 62 is sufficient to transmit the torque developed by the actuator to the arm 59 so as to move the control member 17 against the action of the spring 21 together with any frictional resistance associated with the control member and the parts which move therewith. In use, an electric current is supplied to the stator of the actuator and the force developed by the actuator will be balanced against the force exerted by the spring 21 so that the control member 17 will assume a desired position. When the flow of electric current to the actuator is stopped then the spring 21 will return the control member to the zero fuel position. It is possible, however, that the actuator may seize and in such circumstances it is necessary to be able to cut off the supply of fuel to the engine in order that damage to the engine should not occur. For this purpose a manually operable stop control is provided and this includes a lever 65 on the exterior of the housing 11, the lever being carried upon a shaft 66. The shaft 66 within the compartment 27 mounts an arm 67 the extent of movement of which is determined by a pin 68 engageable against the end faces of an arcuate recess formed in part of the arm 67. The end of the arm 67 is engageable with a surface defined on the follower 22 and when the lever 65 is moved angularly the control member will be moved to the zero fuel position and during such movement the spring 62 will be stressed and separation of the abutment 61 and the pin 57 will occur. The lever 65 is held in the stop position until the engine stops whereafter it can be released.

The supply of electric current to the actuator is controlled by an electronic governor circuit to which the speed transducer 31 provides a signal indicative of the speed of the associated engine. A signal is also provided to the electronic governor circuit indicative of the setting of the control member 17 and this signal is obtained from a position transducer 69 which is housed in the compartment 50. The transducer 69 includes a rotor 70 which is mounted upon an extended portion of the shaft 45 and a stator 71 which is mounted within a cup shaped housing 72 having a peripheral flange in which is formed a plurality of apertures for the reception of bolts 73 engaged within the housing part 49. The stator 71 mounts a magnetising winding and also a pair of signal windings. The mgnetising winding is supplied with alternating current and the signals obtained from the signal windings will vary in accordance with the relative angular positions of the rotor 70 and the stator 71. For adjustment purposes the stator 71 can be moved angularly about the axis of rotation of the shaft 45 by slackening the bolts 73. This angular adjustment can be carried out with the cover 51 removed and can readily be made when the pump is mounted on the engine or on a test bed.

It will be seen that the two housings can be readily separated when servicing is required and the arm assembly 54 is housed within a compartment 27 which can flood with lubricant from the pump. The compartment 28, however, is isolated from the compartment 27 by a simple form of seal which is of well known construction and furthermore, provides minimum frictional loss.

I claim:

1. A fuel pump assembly comprising a first housing for containing injection pump means, a second housing secured to the first housing including a housing part secured to a main part of the second housing, an end plate located within said main part of the second housing in spaced relationship to said housing part, sealing means provided intermediate said end plate and said main part of the housing said end plate constituting a dividing wall defining in said second housing a first and second compartment, a movable control member extending from said first housing into said first compartment, an actuator located in said second compartment having an output shaft extending through said end plate, said shaft having an axis of movement substantially at right angles to but offset from an axis of movement of said control member, link means mounted on said shaft engageable with said control member, and a fluid seal member mounted on said end plate engaging with said shaft to prevent flow of lubricant between said compartments.

2. An assembly according to claim 1 in which said control member is provided with a spring housed within said first compartment, said spring acting to urge the control member to a minimum fuel position.

3. An assembly according to claim 2 in which said spring is a coiled compression spring, the spring surrounding the control member and one end of the spring engaging a surface defined on a follower secured to the control member.

4. An assembly according to claim 3 in which the other end of said spring engages a flange formed on a bearing bush housed within an end wall of the first housing and serving to guide the movement of the control member.

5. An assembly according to claim 1 claims in which said fluid seal member comprises a lip seal.

6. An assembly according to claim 1 in which said housing part and said end plate mount bearings respectively for said shaft.

7. An assembly according to claim 6 in which a stator portion of the actuator is located between said housing part and said end plate.

8. An assembly according to claim 7 in which said housing part defines a further compartment, said shaft extending into said further compartment and mounting a rotor of a position transducer, said transducer including a stator which is adjustably secured to said housing part.

9. An assembly according to claim 8 including a cover for said housing part, said cover being removable to obtain access to bolts serving to secure the stator portion of the transducer to said housing part.

10. An assembly according to claim 3 in which said link means comprises an arm movable by said shaft and a roller mounted on said arm and engageable with said follower to move the control member against the action of said spring.

11. An assembly according to claim 10 including a yieldable connection between said arm and said shaft, the assembly including a manually operable lever operable to effect movement of the control member to the minimum fuel position.

12. An assembly according to claim 10 in which said arm is mounted on a bush angularly movable about said shaft, a further arm being mounted on said bush, a drive arm secured to said shaft, pre-stressed resilient means transmitting force between said drive arm and said further arm, and means limiting relative movement of the drive arm and further arm under the action of said resilient means.

13. An assembly according to claim 12 in which said resilient means comprises a coiled torsion spring, said means limiting relative movement comprising an abutment and a pin on the arms respectively.

14. An assembly according to claim 13 including stop means for limiting the movement of the control member under the action of said coiled compression spring.

15. An assembly according to claim 14 in which said stop means comprises a pin engageable with said first mentioned arm.

16. An assembly according to claim 15 including manually operable means engageable with said follower to move said control member to the minimum fuel position, said torsion spring during operation of said manually operable lever being further stressed in the event that the shaft has become fixed at some angular position other than that which corresponds to the minimum fuel position.

17. An assembly according to claim 1 in which said second housing defines a third compartment, said third compartment housing a speed transducer adapted to be driven from a rotary part of the assembly.

18. An assembly according to claim 17 in which said rotary part comprises a cam shaft mounted in the first housing.

19. An assembly according to claim 18 in which said speed transducer includes a rotary shaft mounted on spaced bearings, one of said bearings being mounted in an end wall of the second housing, and an oil seal adjacent said one bearing, said oil seal establishing a seal with said shaft to prevent flow of lubricant into said third compartment.

20. An assembly according to claim 19 including a slot formed in the end of the shaft of the transducer, said slot being engaged by a spring loaded pin mounted in a bore in the cam shaft, said bore being eccentrically disposed relative to the axis of rotation of the cam shaft.

* * * * *